United States Patent [19]

Litherland et al.

[11] Patent Number: 5,013,923

[45] Date of Patent: May 7, 1991

[54] MASS RECOMBINATOR FOR ACCELERATOR MASS SPECTROMETRY

[75] Inventors: Albert E. Litherland, Toronto; Linas R. Kilius, Thornhill, both of Canada

[73] Assignee: University of Toronto Innovations Foundation, Toronto, Canada

[21] Appl. No.: 487,207

[22] Filed: Mar. 1, 1990

[51] Int. Cl.[5] ..... H01J 3/12

[52] U.S. Cl. ..... 250/396 R; 250/296; 250/294

[58] Field of Search ..... 250/396 R, 396 ML, 296, 250/294

[56] References Cited

U.S. PATENT DOCUMENTS

| | | | |
|---|---|---|---|
| 4,191,887 | 3/1980 | Brown | 250/396 ML |
| 4,489,237 | 12/1984 | Litherland et al. | 250/282 |
| 4,754,135 | 6/1988 | Jackson | 250/294 |

*Primary Examiner*—Jack I. Berman

*Attorney, Agent, or Firm*—Henry C. Nields

[57] ABSTRACT

The invention comprises of four magnet system for dispersing and recombining precisely several isotopes for injection into a tandem accelerator. The precise horizontal focusing of the ions is achieved magnetically using curved boundaries of the magnets which have normal entrance and exit boundaries for the central trajectories. The precise vertical focusing is achieved mainly by the electric slot lenses in the first version, with small adjustments of the focusing of the isotopes, other than the central trajectory isotope, by curved boundaries of the magnet. It is the use of the electric slot lenses, or a similar electric device with one dimensional focusing, which in part decouples the focusing action in the vertical plane from the horizontal plane, that permits the use of four fold magnetic symmetry and boundary curvature to accomplish true recombination of the isotopes in a practical and compact device.

5 Claims, 4 Drawing Sheets

MASS RECOMBINATOR FOR ACCELERATOR MASS SPECTROMETRY

BACKGROUND OF THE INVENTION

1. Field of the Invention

This invention is concerned with an improvement in or relating to apparatus for mass spectrometry and especially for such apparatus that can achieve high accuracy, better than +/−0.2%, at ultra-high sensitivity, better than one part per trillion ($10^{-12}$), for the measurement of the ratios of rare isotopes, such as $^{14}C$, to the abundant isotopes, in this case $^{12}C$ and $^{13}C$.

2. Review of the Prior Art

There is a continuing need to increase the accuracy of the measurements of rare naturally occurring isotopes such as $^{14}C$ in small (1 milligram) samples of carbon. These measurements require the addition of a tandem accelerator, after the low energy negative ion mass spectrometry, to accelerate the ions to a few million electron volts so that all molecular interferences, such as $^{12}CH^{-}_{2}$ and $^{13}CH^{-}$, can be eliminated. This elimination is accomplished by the passage of the ions through a long tube (typically 6.6 mm diameter and 800 mm long) of higher gas pressure, known as a stripping canal, located in the center of the tandem accelerator where the ions loose four electrons to become triply charged positive ions These ions are then accelerated further by the accelerator and analyzed by another mass spectrometer system prior to counting the individual ions. This procedure for the destruction of molecular interferences is the basis of U.S. Pat. No. 4,037,100 for mass spectrometry issued on July 19, 1977. The general features of a recombinator for ions differing in energy and time of flight (known as an Isochronator) are described in U.S. Pat. No. 4,489,237 dated Dec. 18, 1984. The device described herein is a practical version of a mass recombinator with mass dispersion and selection midway through the system and spatial recombination of all masses at the end. What the Isochronator referred to in the above mentioned patent does for ions with differing flight time through the spectrometer, this device does for ions of differing mass.

In another development some isobaric interferences were also eliminated by exploiting the negative ion instability of one member of the isobaric pair. For example, the $^{14}C$ negative ion is stable whereas the $^{14}N$ negative ion is so unstable that it is not transmitted through the mass spectrometer.

Several devices based upon the principles outlined above have been constructed successfully. However the use of a stripping canal and the analysis of one isotope of carbon at a time reduces the time for analysis of the rare carbon isotope, $^{14}C$, and introduces the possibility of errors due to the variable ion transmission probability through the system.

Conventional mass spectrometers have for many years exploited the simultaneous measurement of several isotopes to improve the accuracy and shorten the analysis time. A system to inject isotopes simultaneously into a tandem accelerator has been described. This system disperses and recombines the different mass isotope beams in direction only and each ion beam is focused to a different point in space. As all ions must pass through the same narrow stripping canal, this feature is undesirable for high accuracy work and a system which first disperses all isotopes for mass analysis and then recombines them precisely at the same point prior to injecting them into the accelerator is necessary for the highest accuracy work.

There is a need for rare isotope analysis system which can: (a) determine isotope abundances between the parts per trillion ($10^{-12}$)and the parts per quadrillion ($10^{-15}$) region, (b) have high sensitivity and low background to reduce counting time for each sample or to achieve the maximum measurement accuracy in the shortest time.

SUMMARY OF THE INVENTION

In accordance with the invention, there is provided a method for mass analyzing an ion beam from an ion source followed by the complete spatial recombination of the ion beam for injection into an accelerator and, after the first stage of tandem acceleration, the passage through a long gas-filled stripping canal of all injected ions. The mass spectrometer system for accomplishing this aim is known hereinafter as a recombinator.

The recombinator is a large mass range device related to the Brown achromat described by K. L. Brown at IEEE Trans. Nucl. Sci. NS-26(1979)3490. It has, as a result, by design a four-fold symmetry in the horizontal plane which is essential to the design. The four-fold symmetry ensures that the second order and all even order geometrical aberrations in the horizontal plane are zero.

The recombinator described in this invention differs significantly from the Brown achromat in that:

(a) it covers a broad range of isotope masses, (b) the horizontal and vertical focusing are, for greater simplicity, separated and accomplished by different means.

The recombinator described herein is designed for the precise simultaneous injection of the three carbon isotopes $^{12}C$, $^{13}C$ and $^{14}C$ into a tandem accelerator and the elimination of atoms and molecules of other masses. This separation is accomplished by apertures at the mid-point of the recombinator.

The ion beam focusing achieves the aim of recombining the ion beams at a point after the recombinator in the following manner:

(a) The focusing in the horizontal direction is purely magnetic with normal entrance and exit boundaries, for the central ion trajectory, for each of the four magnets. The ion traJectories of the same mass from a point object are parallel in between the first and second and between the third and fourth magnets, (b) The primary vertical focusing is achieved by an electric slot lens symmetrically placed between the first and second and between the third and fourth magnet, (c) The three isotopes of carbon follow different trajectories through the recombinator and it is necessary to curve the four boundaries of the magnets, labeled 1–4 in FIG. 1. This adjusts the second order horizontal and vertical focusing to ensure that the focal plane at the mid-point of the system is normal to the central trajectory, (d) All eight boundaries are also curved, in the symmetrical manner shown, to achieve the four-fold symmetry of the Brown achromat in the horizontal plane. This reduces the total second order aberration of the focusing system in that plane.

Figure 1:
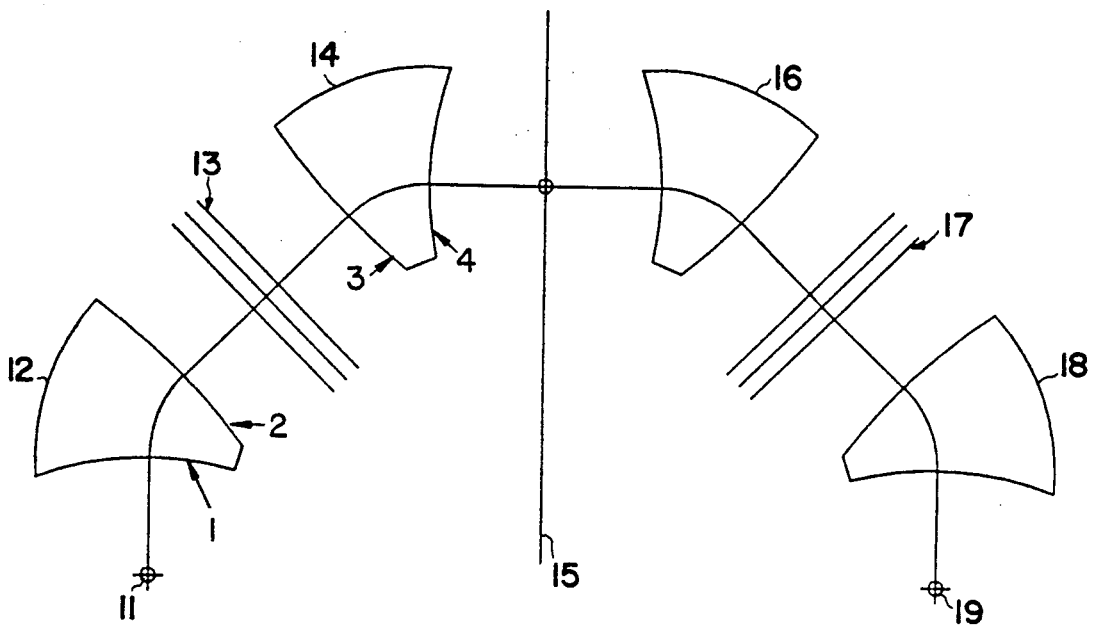
FIG. 1 is a schematic drawing of the mass recombinator of the instant invention.
Figure 1A:
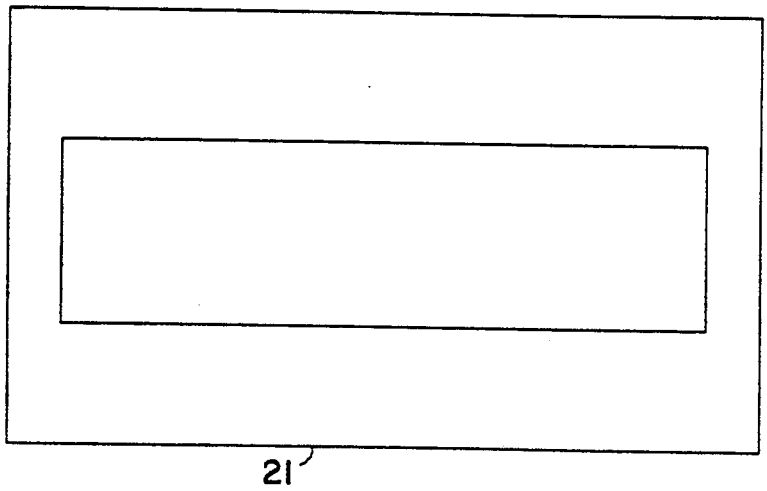
FIGS. 1A and 1B are horizontal and end views, respectively, of an electric slot lens as used in the apparatus of FIG. 1.
Figure 1B:
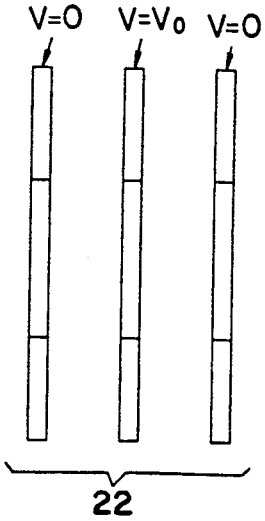

Referring to the drawings and first to FIG. 1 thereof, therein is shown somewhat schematically the mass recombinator of the invention. Ions generated in a suitable ion source are extracted therefrom and converted to a beam of negative ions by means well known in the art. For example, a beam of negative ions which includes the three carbon isotopes $^{12}C$, $^{13}C$ and $^{14}C$ may be produced in this manner. The negative ion beam is then injected into the mass recombinator shown in FIG. 1, which includes a plurality of magnets having gaps through which the negative ion beam travels in sequence. These magnets bend the ion beam in the plane of the drawing, and this plane is referred to hereinafter as the "bending plane" or the "horizontal plane". In this way the magnets provide a mass-analyzing function in accordance with well-known principles, separating the ion beam into a family of trajectories followed by ions of different mass.

In addition to serving a mass-analyzing function, the magnets of FIG. 1 also perform a horizontal focusing function. In accordance with the invention the magnets form a reflectionsymmetric system, and so at least four magnets are required. These magnets are symmetrically configured and telescopic. One form of a type of four magnet system having similar symmetries is disclosed in the aforementioned publication by Brown, the disclosure of which is incorporated herein by reference. Reference is particularly made to Example 2 of said Brown publication, which discloses a so-called "unit cell" using a combined function magnet: i.e., a magnet which performs a focusing function as well as mass-analyzing function. The magnet system of FIG. 1 of the present specification is similar to that of Brown's Example 2 in that both comprise at least four unit cells using a combined function magnet. The two systems differ in several respects, however, one of which relates to focusing in the "non-bending" or vertical plane i.e., any plane perpendicular to the plane of the drawing Brown's system introduces a quadrupole component, focusing in the non-bending (vertical) plane and defocusing in the bending (horizontal) plane, via the rotated input face of the magnet. Such quadrupole focusing inherently couples the vertical focusing to the horizontal focusing. Such coupling is acceptable in the Brown device, in which a small spread of ion energies are dispersed and recombined. Such coupling is not acceptable in the present invention, because the purpose of the present invention is to separate, select and recombine a plurality of ion beams of different masses, thereby requiring the independent focusing of off-axis components as well as the on-axis components. By decoupling the vertical and horizontal focusing, the mid-point focal planes can be chosen so than the tilt of these planes are equal and opposite. Thereafter a simple adjustment of the curved boundaries, set forth hereinafter, will rotate these focal planes in such a direction as to be normal to the central plane. This has the effect of producing the desired recombination of the ion masses at the end of the recombinator. The invention achieves decoupling, in part, by so designing the magnets that focusing (or defocusing) in the non-bend (vertical) plane is essentially avoided (except for trimming effects). This is accomplished by not rotating the input face of any of the magnets: i.e., the input face of each magnet is normal to the central ion trajectory. However, both input and output surfaces may be curved, for purposes to be set forth hereinafter.

Having designed the magnets so that essentially they provide no vertical focusing, in accordance with the invention vertical focusing is provided by electric slot lenses, the focusing effect of which is inherently decoupled from the focusing effects of the magnet system.

The electric slot lenses function on the principles of the einzel lens, and the long rectangular aperture confines the focusing effect to the vertical dimension, the length of said aperture extending in the horizontal direction.

The electric slot lenses are essentially one-dimensional einzel lenses; and thus they provide focusing in the vertical dimension only. Thus the electric slot lenses are the key to a simple recombinator for plural-trajectory beams. Each lens comprises three rectangularly shaped apertured plates, the outer two plates being at ground potential, and the center plate having a potential of approximately one-half the voltage of the incoming ion beam. Thus, if the incoming beam is a beam of negative ions of 40 KeVolts energy, a potential of about −20 kVolts is approximate for the center plate. The lens thus acts as a retarding einzel lens.

By the aforementioned means, the vertical focusing is decoupled from the horizontal focusing. Many recombinators are available currently, but al are totally unsuitable for simultaneous focusing of on-axis and off-axis beams; the key to the success of this design is this decoupling of horizontal and vertical focusing.

Among the four magnets, only the boundaries of the last of the first pair and the first of the last pair need be curved; and the curve must have a definite shape. The curves on all boundaries are circles constructed to be plane symmetric about the mid-point plane in FIG. 1 For the system described in FIG. 1, a mid-point horizontal plane focus is produced by the first two magnets and a mid-system vertical plane focus is produced by the slot lens. For the mid-system focal plane to be perpendicular to the central ion trajectory, only one solution is possible for the radii of curvature of the entrance and exit of each magnet. This is true for any one combination of magnet bending angle, primary radius of curvature and field index. The sense of the curvature is also unique as specified in FIG 1.

The curvature of the other boundaries has a trimming function. However, each curve is costly to manufacture, and so in certain instances these "trimming" boundaries may have a flat configuration. It is also desirable that the radii of curvature for these boundaries be as large as possible with respect to the bending radius of curvature of the magnet to ensure small second order aberrations of the system.

The invention deals with device in which an ion beam containing various particles is split up, and perhaps three types of particles, each of distinct mass, and selected for observation and treatment For example, if one of the species is more intense than the other two, it may be dampened independently while the three component beams are separate. The prior art has shown how to cause all three species to arrive at the same approximate spot, but the focusing and other characteristics of the three species beams are different. The device of the invention causes the three species to arrive at the same spot while having the same spectral properties. The operation of the invention includes many subtleties which result in an elegant performance.

VARIATIONS TO THE RECOMBINATOR (A) As an alternate form, the slot lens focusing action can be reduced, by lowering the lens voltage further, so that a vertical focus is produced only at the end of the recombinator. Multiple solutions for the entrance and exit boundary curvatures now become possible The removal of the additional mid-system vertical focus reduces some of the second order and third order system aberration. This solution is not as desirable because no simultaneous vertical and horizontal mid-point focusing is possible.

Figure 2:
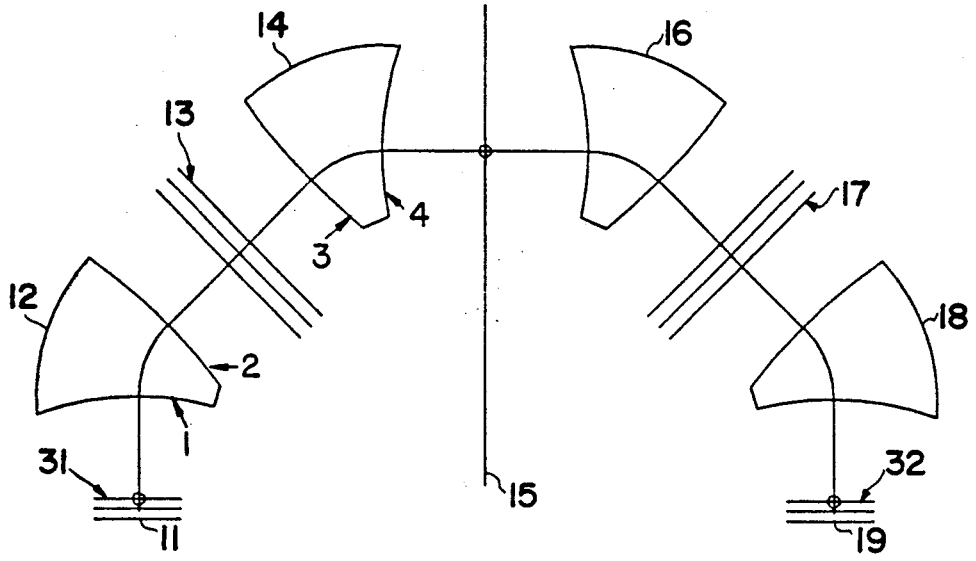
FIG. 2 shows an alternative embodiment of the invention.

(B) A similar reduction n higher order aberrations is made possible for the system described in FIG. 1 by the addition of a slot lens at the start and end of the system with ½ the field strength of the slot lens between the magnets 1 and 2; 3 and 4. This system is described schematically in FIG. 2. This produces a unit cell structure for the vertical focusing plane which does not couple aberrations in the same manner as (A).

Figure 3:
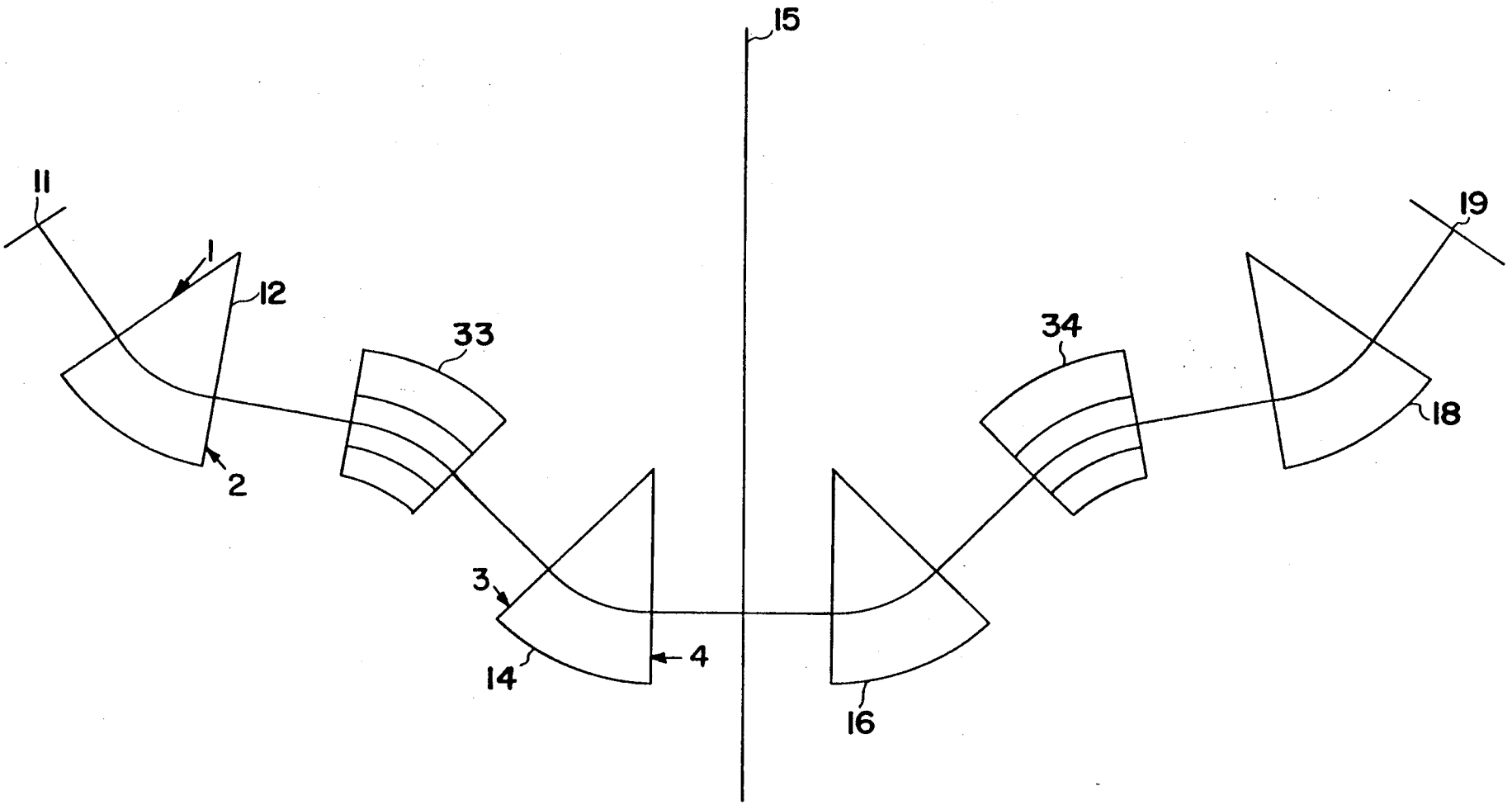
FIG. 3 shows a third embodiment of the instant invention.

(C) As an alternative to the slot lens, a toroidal electric analyzer with a field index of 2 (defined as the vertical to horizontal radii of curvature of the central field of the analyzer) will focus in the vertical plane and not in the horizontal plane. These toroidal electric analyzers are difficult to build but offer the additional advantage of electric analysis in the system which removes ions that differ in energy and would otherwise complicate the final spectrum. This variant is illustrated schematically in FIG. 3.

Figure 4:
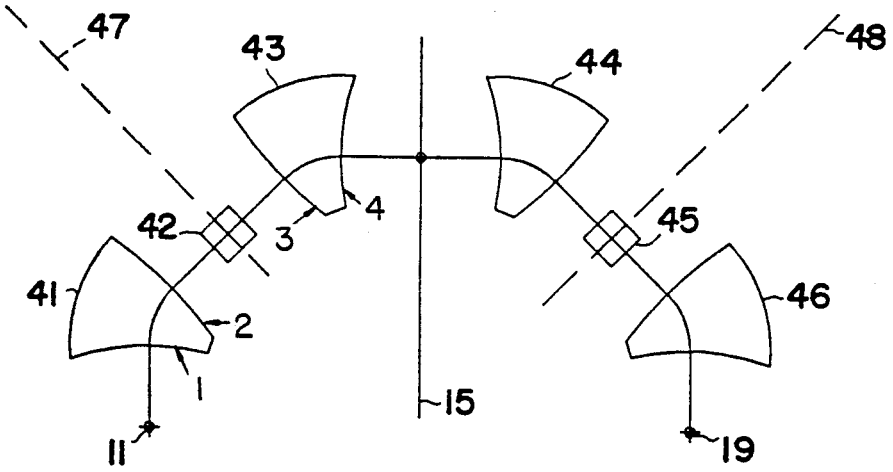
FIG. 4 shows a fourth embodiment of the instant invention.
Figure 4A:
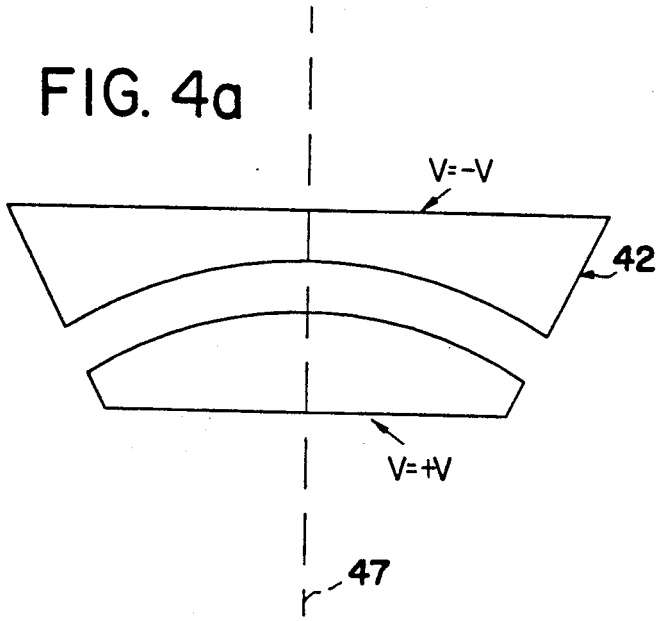
FIG. 4A shows a cylindrical electric analyzer as used in the embodiment of FIG. 4.
Figure 2A:
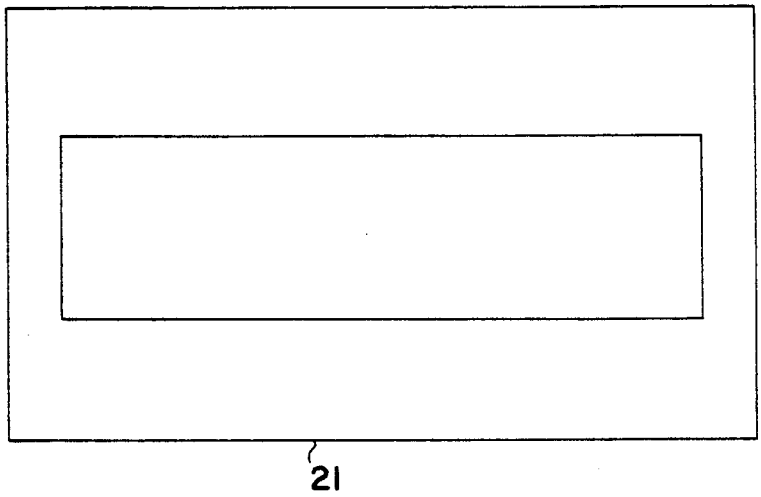
FIGS. 2A and 2B are horizontal and end views, respectively, of an electric slot lens as used in the apparatus of FIG. 2.
Figure 2B:
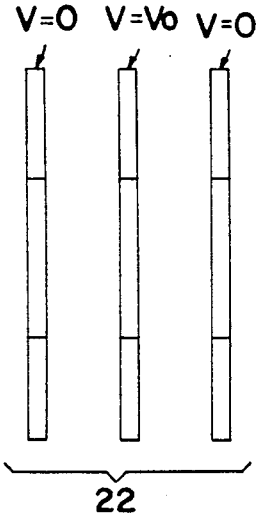

(D) A simplified version of the toroidal electric analyzer is a cylindrical electric analyzer. This device bends and focuses in the horizontal plane but not in the vertical plane. For this device to be of value to the recombinator, i.e. to provide a decoupling of the vertical and horizontal focusing action, these devices can be used in place of the slot lenses but must be rotated 90 degrees so that they now bend out of the plane of the paper of FIG. 4. This produces the desired vertical focusing action. The resultant three dimensional structure of this system is more complicated to align but offers the benefits of design simplicity as the cylindrical analyzer is easy to build and provides the additional energy selection similar to the previously described toroidal analyzer.

All the above variations serve to replace the slot lenses of FIG. 1 with a device having equivalent vertical focusing action with no horizontal focusing component. The entrance and exit magnet boundary curvature need to be adjusted for each electric substitution to achieve the required recombination of dispersed masses.

In the drawings the following reference numerals have the following meanings:

11. Start
12. Magnet 1
13. Electric slot lens
14. Magnet 2
15. Mid-point plane
16. Magnet 3
17. Electric slot lens
18. Magnet 4
19. End

21. Front view of slot lens
22. Side view of slot lens

31. Electric slot lens $V<Vo$
32. Electric slot lens $V<Vo$
33. Toroidal Electric Analyzer 1
34. Toroidal Electric Analyzer 2

41. Magnet 1
42. Cylindrical Electric Analyzer 1
43. Magnet 2
44. Magnet 3
45. Cylindrical Electric Analyzer 2
46. Magnet 4
47. Symmetry Plane for the Cylindrical Electric Analyzer 1
48. Symmetry Plane for the Cylindrical Electric Analyzer 2

We claim:

1. A mass recombinator, comprising in combination means for producing a beam of ions including ions of a plurality of masses so that the ions in said beam follow a family of trajectories including central trajectories, magnetic means for bending said ion beam in a bending plane, said magnetic means also focusing said ion beam in the bending plane but causing no primary focusing in planes perpendicular to (orthogonal to) said bending plane, electric means for focusing said ion beam in the non-bending plane (defined as a plane which is transverse to the bending plane and includes the beam trajectory in the area of focusing action), said magnetic means including at least two pairs of deflecting magnets traversed in sequence by the ion beam, the boundary faces of said magnets being normal to the central trajectories of the ion beam as they traverse the boundary, said electric means comprising an electric lens between the members of each pair of magnets.

2. A mass recombinator in accordance with claim 1, wherein said electric lens is an electric slot lens.

3. A mass recombinator in accordance with claim 1, wherein said electric lens is a toroidal electric analyzer.

4. A mass recombinator in accordance with claim 1, wherein said electric lens is a cylindrical electric analyzer.

5. Apparatus for injecting several selected mass species into a device comprising in combination: means for producing a beam of ions of several mass species: a second-order magnetic optical achromat comprising at least four unit cells adjusted to a total angle of 180°, each said unit cell comprising a combined function magnet and a drift space preceding and following it; means for directing said beam through said achromat along a family of trajectories; a first electric slot lens between the first pair of said unit cells to be traversed by said beam, a second electric slot lens between the second pair of said unit cells to be traversed by said beam; aperture means along said family of trajectories adapted to remove all ions except those of selected masses from said beam; the input faces of each of said combined function magnets not being rotated, so that no quadrupole component is introduced via any rotated input face, whereby focusing in the bending plane is accomplished by said achromat and focusing in the non-bending plane is decoupled from said focusing in the bending plane and is accomplished by said electric slot lenses, the various parameters of said achromat and said electric slot lenses being adjusted to provide recombination of the trajectories of the selected mass species for injecting into said device.

* * * * *